US008035581B2

(12) United States Patent
Choi

(10) Patent No.: US 8,035,581 B2
(45) Date of Patent: Oct. 11, 2011

(54) SCAN DRIVER, ORGANIC LIGHT EMITTING DISPLAY USING THE SAME, AND METHOD OF DRIVING THE ORGANIC LIGHT EMITTING DISPLAY

(75) Inventor: Sang Moo Choi, Suwon-si (KR)

(73) Assignee: Samsung Mobile Display Co., Ltd. (KR)

( * ) Notice: Subject to any disclaimer, the term of this patent is extended or adjusted under 35 U.S.C. 154(b) by 844 days.

(21) Appl. No.: 11/305,890

(22) Filed: Dec. 16, 2005

(65) Prior Publication Data

US 2006/0158394 A1 Jul. 20, 2006

(30) Foreign Application Priority Data

Dec. 24, 2004 (KR) ..... 10-2004-0112516

(51) Int. Cl.
*G09G 3/30* (2006.01)

(52) U.S. Cl. ..... 345/76

(58) Field of Classification Search ..... 345/76
See application file for complete search history.

(56) References Cited

U.S. PATENT DOCUMENTS

| | | | | |
|---|---|---|---|---|
| 5,568,163 | A | 10/1996 | Okumura | |
| 5,654,659 | A * | 8/1997 | Asada | 327/208 |
| 2003/0178947 | A1 * | 9/2003 | Shin et al. | 315/169.3 |
| 2004/0001054 | A1 | 1/2004 | Nitta et al. | |
| 2005/0062692 | A1 | 3/2005 | Lo et al. | |

FOREIGN PATENT DOCUMENTS

| | | | |
|---|---|---|---|
| EP | 1 424 674 | A | 6/2004 |
| EP | 1 662 463 | A2 | 5/2006 |
| EP | 1 667 092 | A | 6/2006 |
| JP | 05-119741 | A | 5/1993 |
| JP | 06-208340 | A | 7/1994 |
| JP | 2001-195043 | A | 4/2000 |
| JP | 2001-324958 | | 11/2001 |
| JP | 2001-324958 | A | 11/2001 |
| JP | 2003-280610 | A | 3/2002 |

(Continued)

OTHER PUBLICATIONS

Office Action issued by the Japanese Patent Office on Jul. 8, 2008 in Japanese Patent Application No. 2005-315251.

(Continued)

*Primary Examiner* — Amr Awad
*Assistant Examiner* — Jonathan Boyd
(74) *Attorney, Agent, or Firm* — Knobbe Martens Olson & Bear, LLP

(57) ABSTRACT

Embodiments of a scan driver capable of freely adjusting the width of emission control signals are disclosed. One embodiment of the scan driver comprises a shift register configured to sequentially shift a start pulse in response to a clock signal to generate sampling pulses, a NOR gate coupled to each emission control line and configured to generate emission control signals in response to at least two sampling pulses, and a NAND gate coupled to each scan line to generate scan signals in response to at least two sampling pulses. At least one of the two sampling pulses input to the NAND gate is input via an inverter. The width of the start pulse is thus controllable to freely adjust the width of the emission control signals. Accordingly, the brightness of an organic light emitting display employing the scan driver can be freely adjusted.

25 Claims, 6 Drawing Sheets

FOREIGN PATENT DOCUMENTS

| | | | |
|---|---|---|---|
| JP | 2002-268615 | | 9/2002 |
| JP | 2004-163777 | A | 11/2002 |
| JP | 2003-076331 | A | 3/2003 |
| JP | 2003-140619 | | 5/2003 |
| JP | 2003-157064 | | 5/2003 |
| JP | 2003-157064 | A | 5/2003 |
| JP | 2003-173154 | A | 6/2003 |
| JP | 2003-216100 | | 7/2003 |
| JP | 2003-223138 | | 8/2003 |
| JP | 2003-223138 | A | 8/2003 |
| JP | 2003-255899 | | 9/2003 |
| JP | 2004-094058 | A | 3/2004 |
| JP | 2004-151693 | | 5/2004 |
| JP | 2004-226673 | | 8/2004 |
| JP | 2004-318093 | | 11/2004 |
| JP | 2005-049838 | | 2/2005 |
| JP | 2005-338837 | A | 12/2005 |
| JP | 2006-011368 | A | 1/2006 |
| JP | 2006-072321 | A | 3/2006 |
| KR | 10-2004-0094601 | | 12/2002 |
| WO | WO 98/36407 | | 8/1998 |
| WO | WO 03/027998 | A1 | 4/2003 |

OTHER PUBLICATIONS

Office Action issued by the SIPO on Nov. 23, 2007.

Chinese Office Action issued by the State Intellectual Property Office of P.R. China on Jun. 6, 2008 for Chinese Patent Application No. CN 200610072046.

Japanese Office Action dated Dec. 8, 2009 for Japanese Patent Application No. JP 2006-104426.

Office Action dated Jun. 19, 2009 for related U.S. Appl. No. 11/364,590, filed Feb. 28, 2006.

Office Action dated Dec. 22, 2009 for related U.S. Appl. No. 11/364,590, filed Feb. 28, 2006.

Office Action dated May 14, 2010 for related U.S. Appl. No. 11/364,590, filed Feb. 28, 2006.

Office Action dated Nov. 26, 2010 for related U.S. Appl. No. 11/364,590, filed Feb. 28, 2006.

Japanese Office Action dated Oct. 19, 2010 from Japanese Patent Application No. JP 2005-315251 claiming priority to KR 10-2004-0112516 which corresponds to the captioned application.

Office Action dated May 12, 2011 for related U.S. Appl. No. 11/364,590, filed Feb. 28, 2006.

* cited by examiner

SCAN DRIVER, ORGANIC LIGHT EMITTING DISPLAY USING THE SAME, AND METHOD OF DRIVING THE ORGANIC LIGHT EMITTING DISPLAY

CROSS-REFERENCE TO RELATED APPLICATIONS

This application claims the benefit of Korean Patent Application No. 10-2004-112516, filed on Dec. 24, 2004, in the Korean Intellectual Property Office, the disclosure of which is incorporated herein by reference.

BACKGROUND

1. Field of the Invention

The present invention relates generally to a scan driver for an organic light emitting display, and more particularly to a scan driver configured to of freely adjust the widths of emission control signals, an organic light emitting display employing the scan driver, and a method of driving the organic light emitting display.

2. Discussion of Related Technology

Various flat panel displays have been developed with reduced weight and volume to overcome the disadvantages of cathode ray tube (CRT) displays. Exemplary types of flat panel displays include liquid crystal displays (LCDs), field emission displays (FEDs), plasma display panels (PDPs), and organic light emitting displays.

An organic light emitting display is a spontaneous emission device that emits light by re-combination of electrons and holes. Organic light emitting displays have a high response speed and are driven with low power consumption. An exemplary organic light emitting display supplies currents corresponding to data signals to an organic light emitting diode using transistors formed in each pixel, such that light is emitted from the organic light emitting diode in response to the supplied currents.

Exemplary organic light emitting displays include a scan driver for selecting pixels and controlling the luminescence of the pixels, and a data driver for supplying the data signals to the selected pixels. The scan driver selects the pixels to which the data signals are to be supplied while sequentially supplying scan signals to scan lines. The scan driver also sequentially supplies emission control signals to emission control lines so as to control the emission time of the pixels.

FIG. 1 is an electrical schematic of an exemplary scan driver 5. The scan driver 5 comprises a shift register 10 and a signal generator 20. The shift register 10 is configured to sequentially shift a start pulse SP, supplied from outside the scan driver 5, in response to a clock signal CLK so as to generate sampling pulses. The signal generator 20 is configured to generate scan signals and emission control signals in response to the sampling pulses, supplied from the shift register 10, and an output enable signal OE, which is supplied from outside the scan driver 5.

The shift register 10 comprises n (where n is an integer) D flip-flops. The D flip-flops DF1 to DFn are driven when the clock signal CLK and the sampling pulses (or the start pulse) are supplied from the outside. In the illustrated scan driver 5, odd D flip-flops (e.g., DF1, DF3, . . . ) are driven at the rising edge of the clock signal CLK and even D flip-flops (e.g., DF2, DF4, . . . ) are driven at the falling edge of the clock signal CLK. Thus, in the exemplary shift register 10, D flip-flops driven at the rising edge of the clock signal CLK and D flip-flops driven at the falling edge of the clock signal CLK are alternately arranged.

The signal generator 20 comprises a plurality of logic gates. In the illustrated scan driver 5, the signal generator 20 includes a NAND gate for each scan line S and a NOR gate for each emission control line E. Thus, the signal generator 20 includes n NAND gates and n NOR gates.

A NAND gate NANDi, connected to an ith scan line Si (wherein i is an integer), is driven by the output enable signal OE, the sampling pulse of the ith D flip-flop DFi, and the sampling pulse of the (i−1)th D flip-flop DFi−1. In the illustrated scan driver, the output of the NAND gate NANDi is supplied to the ith scan line Si through at least one inverter IN and buffer BU in series.

The NOR gate NORi, connected to the ith emission control line Ei, is driven by the sampling pulse of the (i−1)th D flip-flop DFi−1 and the sampling pulse of the ith D flip-flop DFi. In the illustrated scan driver, the output of the NOR gate NORi is supplied to the ith emission control line Ei through at least one inverter IN.

FIG. 2 is an illustration of exemplary waveforms illustrating a method of driving the scan driver 5. According to an exemplary method of driving the scan driver 5, first, the clock signal CLK and the output enable signal OE are supplied from outside the scan driver. In the exemplary method, a period of the output enable signal OE is half (½) of a period of the clock signal CLK. The high state voltages of the output enable signal OE overlap the high state voltages of the clock signal CLK. The low state voltages of the output enable signal OE overlap the clock signal CLK transitions between high and low state voltages. The output enable signal OE controls the width of scan signals SS. In the exemplary method, the scan signals SS are generated to have the same pulse width as the high voltage state pulse widths of the output enable signal OE.

When the clock signal CLK is supplied to the shift register 10 and the output enable signal OE is supplied to the signal generator 20, the start pulse SP is supplied to the shift register 10 and the signal generator 20 from outside the scan driver 5. More particularly, the start pulse SP is supplied to a first D flip-flop DF1, a first NOR gate NOR1, and a first NAND gate NAND1. The first D flip-flop DF1 that receives the start pulse SP is triggered at the rising edge of the clock signal CLK to generate a first sampling pulse S1. The first sampling pulse S1 is supplied to the first NAND gate NAND1, the first NOR gate NOR1, a second NAND gate NAND2, and a second D flip-flop D2.

The first NAND gate NAND1 receives the start pulse SP, the first sampling pulse S1, and the output enable signal OE, and outputs a low voltage (that is, logic low state of 0) when the start pulse SP, the first sampling pulse S1, and the output enable signal OE have high voltages (that is, logic high state of 1). For other input signal combinations, the first NAND gate NAND1 outputs a high state voltage. In the exemplary method, the first NAND gate NAND1 outputs a low state voltage during a portion of the duration of the first sampling pulse S1. The low voltage output from the first NAND gate NAND1 is supplied to the first scan line S1 via a first inverter IN1 and a first buffer BU1. The first scan line S1 supplies the low voltage from the first buffer BU1 as the scan signal SS to the pixels.

The first NOR gate NOR1 receives the start pulse SP and the first sampling pulse S1, and is configured to output a high state voltage when the start pulse SP and the first sampling pulse S1 have low state voltages, and to output a low state voltage in other cases. In the exemplary method, the first NOR gate NOR1 outputs a low state voltage when one of the start pulse SP and the first sampling pulse S1 has a high state voltage. The low voltage output from the first NOR gate NOR1 is changed to a high state voltage via the second inverter IN2 to be supplied to the first emission control line E1. The high voltage at the first emission control line E1 as an emission control signal EMI is also supplied to the pixels.

In the exemplary method, the scan driver 5 sequentially supplies the scan signals SS to the $1^{st}$ through nth scan lines S1 to Sn, respectively, while repeating the above-described processes. Also, the scan driver 5 sequentially supplies the emission control signals EMI to the 1st through nth emission control lines E1 to En, respectively, while repeating the above-described processes. The scan signals SS sequentially select the pixels and the emission control signals EMI control the emission time of the pixels.

In an organic light emitting display employing the scan driver 5 described above, the brightness of the pixels is controlled only by freely controlling the width of the pulse of the emission control signals EMI regardless of the scan signals SS. However, according to the prior art, when the width of the pulse of the emission control signals EMI is set wide (i.e., long duration), desired scan signals SS are not generated.

Specifically, in order to set the width of the pulse of the emission control signals EMI wide, the width of the start pulse SP must be set wide as illustrated in FIG. 3. When the width of the start pulse SP is set wide, the first NOR gate NOR1 performs a logic NOR operation on the outputs of the start pulse SP and the first D flip-flop DF1 to set the width of the generated emission control signals EMI. However, when the width of the start pulse SP is set wide, undesired scan signals SS are generated.

Because the scan signals SS are generated when the start pulse SP, the first sampling pulse S1, and the output enable signal OE have high state voltages, the first NAND gate NAND1 outputs a plurality of low voltages in response to a wide width of the start pulse SP. When the width of the start pulse SP overlaps the three periods of the clock signal CLK, the first NAND gate NAND1 outputs three low voltages as illustrated in FIG. 3. Thus, according to the prior art, when the width of the start pulse SP is set wide, the width of the emission control signals EMI is set no less than two periods of the clock signal CLK since the plurality of scan signals SS are supplied to the scan lines S, respectively. Thus, an improved method of setting the width of emission control signals pulse is needed in the technology.

SUMMARY OF CERTAIN INVENTIVE EMBODIMENTS

Embodiments of the invention include a scan driver configured to freely adjust the width of emission control signals, an organic light emitting display employing the scan driver, and a method of driving the organic light emitting display.

One embodiment of a scan driver comprises a shift register configured to sequentially shift a start pulse, supplied from outside the scan driver, in response to a clock signal to generate a plurality of sampling pulses. The scan driver further comprises a logic NOR gate coupled to an emission control line and configured to generate an emission control signal in response to at least two sampling pulses, and a NAND gate coupled to a scan line and configured to generate a scan signal in response to at least two sampling pulses. At least one of the two sampling pulses input to the NAND gate is input via an inverter.

In certain embodiments of the scan driver, the NAND gate generates a scan signal in response to an output enable signal having a frequency higher than the frequency of the clock signal. In some embodiments, the NOR gate connected to an ith emission control line performs a logic NOR operation in response to an (i−1)th sampling pulse and an ith sampling pulse, wherein i is a positive integer. In certain embodiments, the NAND gate connected to an ith scan line performs a logic NAND operation in response to the ith sampling pulse, an inverted (i+1)th sampling pulse supplied via the inverter, and the output enable signal.

One embodiment of an organic light emitting display comprises a data driver configured to drive a plurality of data lines, a scan driver configured to drive a plurality of scan lines and a plurality of emission control lines, and a pixel portion comprising a plurality of pixels formed in regions partitioned by the scan lines, the emission control lines, and the data lines. The scan driver comprises a shift register configured to sequentially shift a start pulse, supplied from outside the scan driver, in response to a clock signal to generate a plurality of sampling pulses. The scan driver further comprises a logic NOR gate coupled to each emission control line and configured to generate an emission control signal in response to at least two sampling pulses, and a logic NAND gate coupled to each scan line and configured to generate a scan signal in response to at least two sampling pulses. At least one of the at least two sampling pulses input to the NAND gate is input via an inverter.

In certain embodiments, the NAND gate is also responsive to an output enable signal having a frequency higher than the frequency of the clock signal. In some embodiments, the NOR gate connected to an ith emission control line performs a logic NOR operation in response to an (i−1)th sampling pulse and an ith sampling pulse, wherein i is a positive integer. In certain embodiment, the NAND gate connected to an ith scan line performs a logic NAND operation in response to an ith sampling pulse, an inverted (i+1)th sampling pulse supplied via an inverter, and the output enable signal.

One embodiment of a method of driving an organic light emitting display comprises (a) shifting a start pulse, using a plurality of D flip-flops that receive a clock signal, to generate a plurality of sampling pulses, (b) generating a plurality of emission control signals in response to at least two of the sampling pulses, (c) inverting the sampling pulses generated in step (a), and (d) generating a plurality of scan signals in response to the sampling pulses and the inverted sampling pulses.

In one embodiment, the plurality of scan signals are generated in response to an output enable signal in addition to the sampling pulses and the inverted sampling pulses, wherein the output enable signal has a frequency higher than the frequency of the clock signal. In some embodiments, generating the plurality of emission control signals comprises performing a logic NOR operation in response to an (i−1)th sampling pulse and an ith sampling pulse, wherein i is a positive integer, and supplying a signal generated by performing the NOR operation to an emission control line via at least one inverter.

DETAILED DESCRIPTION OF CERTAIN INVENTIVE EMBODIMENTS

The following detailed description is directed to certain specific embodiments of the invention. However, the invention can be embodied in a multitude of different ways as defined and covered by the claims. In this description, reference is made to the drawings wherein like parts are designated with like numerals throughout.

Figure 1:
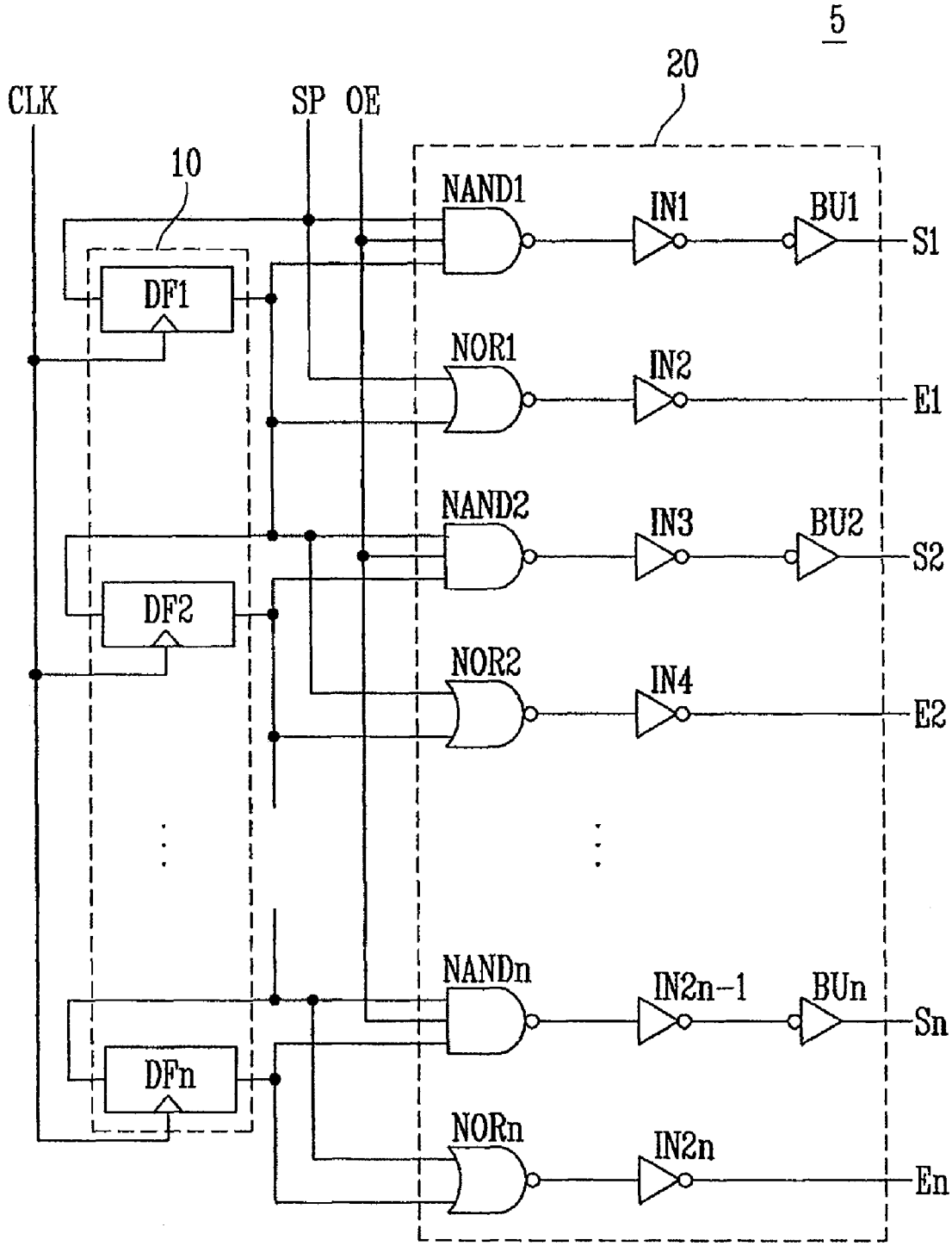
FIG. 1 (PRIOR ART)
FIG. 1 is an electrical schematic of an exemplary scan driver.
Figure 2:
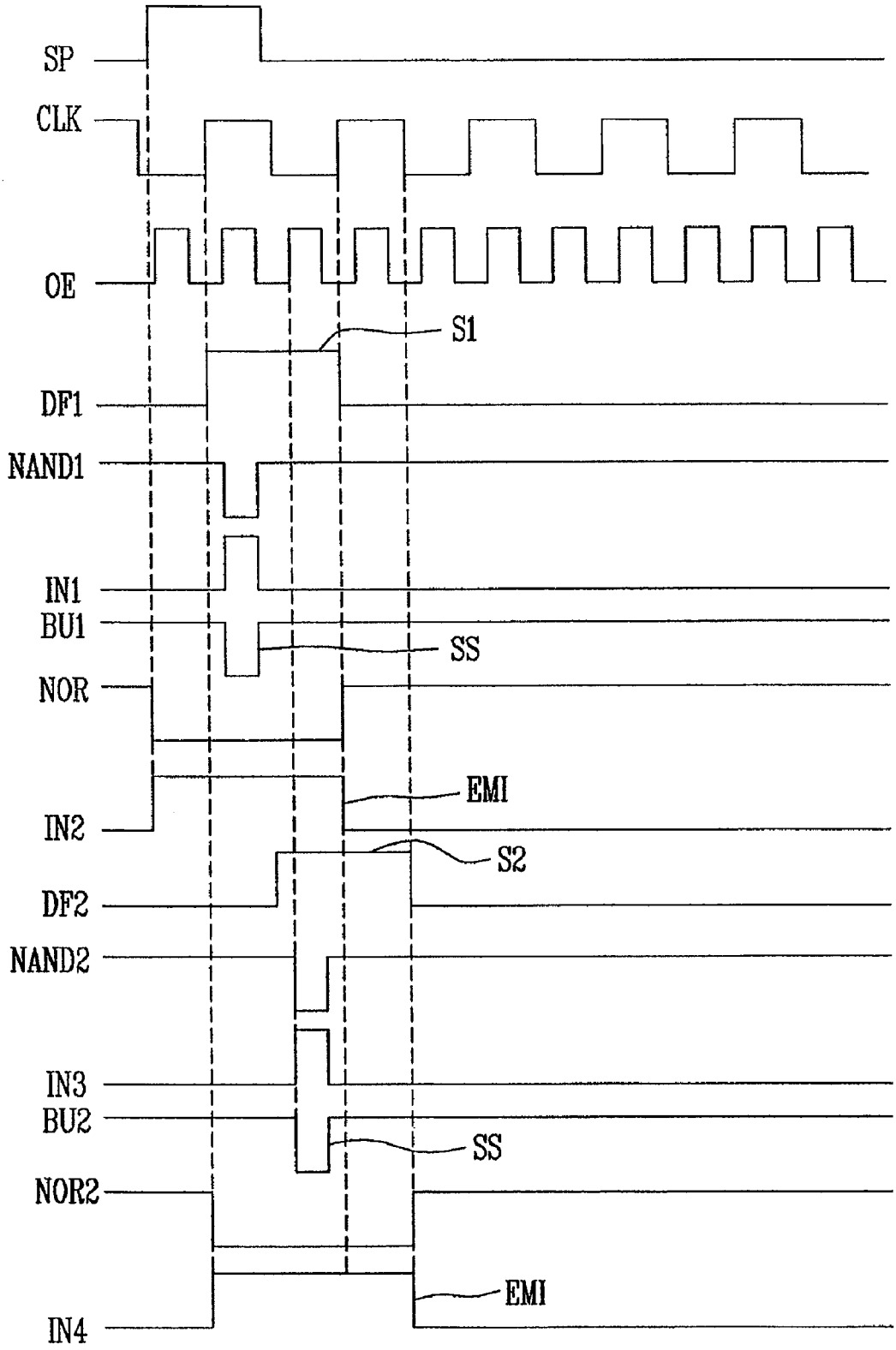
FIG. 2 (PRIOR ART)
FIG. 2 is a timing diagram of exemplary waveforms illustrating an exemplary method of driving the scan driver of FIG. 1.
Figure 3:
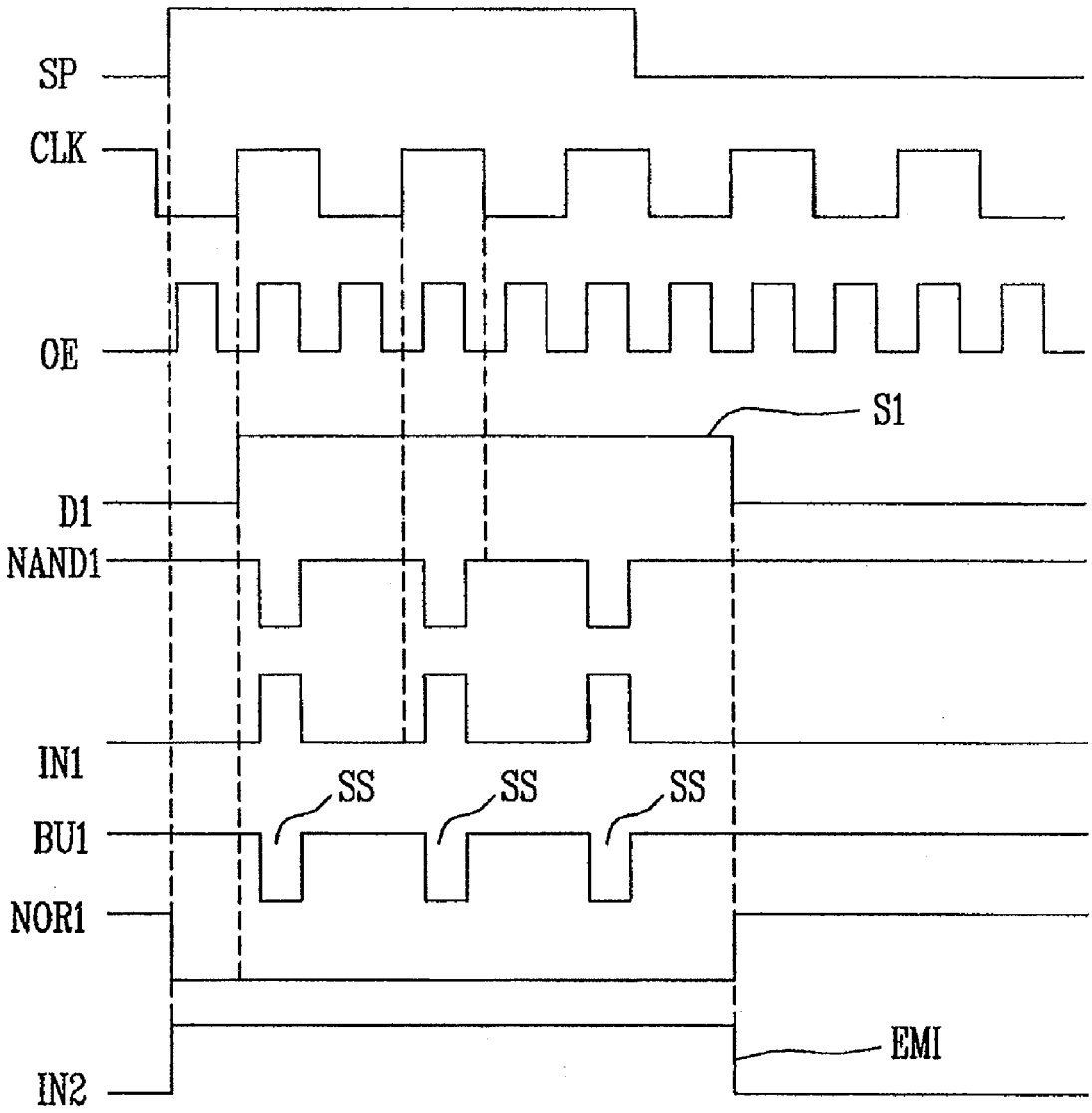
FIG. 3 (PRIOR ART)
FIG. 3 is timing diagram of one embodiment of scan signal waveforms generated in response to supply of a start pulse having a wide pulse width to the scan driver of FIG. 1.
Figure 4:
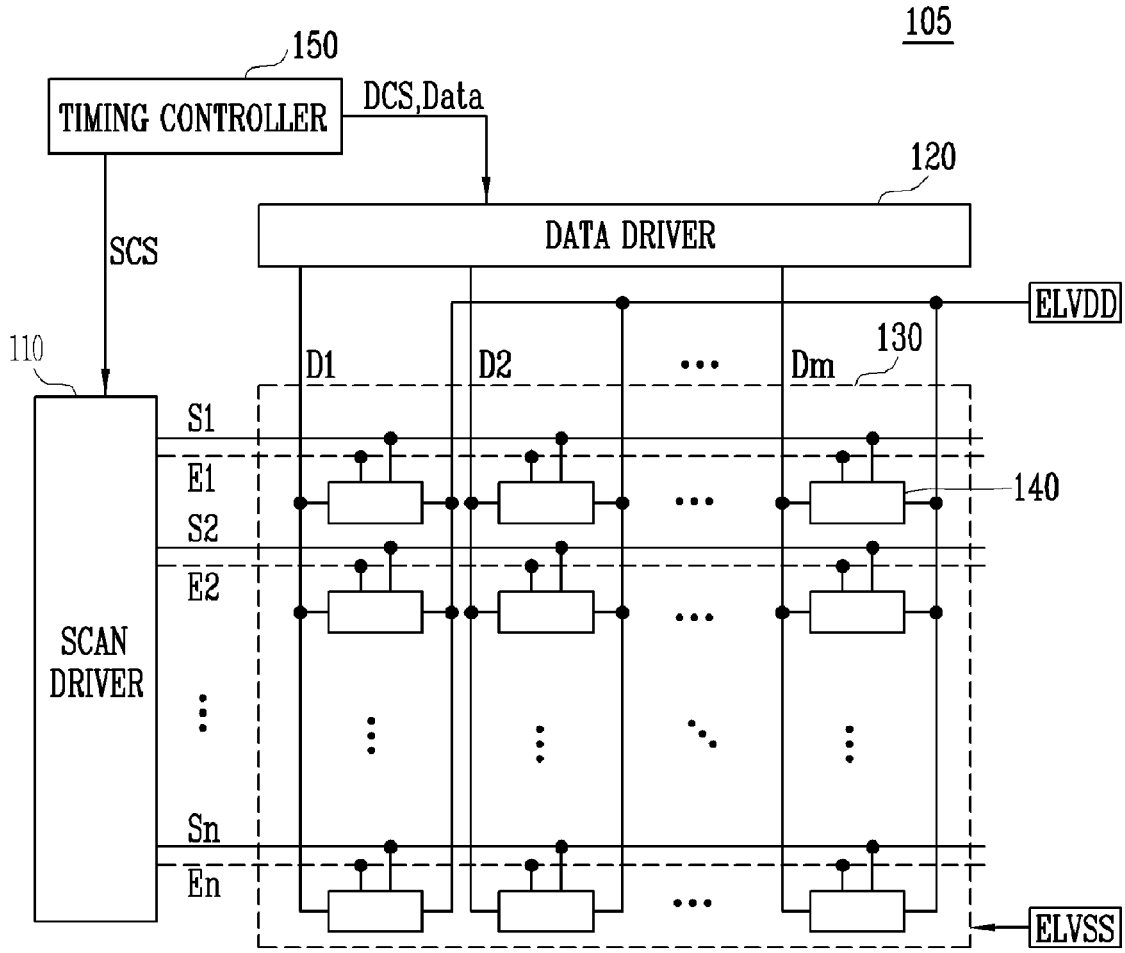
FIG. 4 is a block diagram of one embodiment of an organic light emitting display.

FIG. 4 is a block diagram of one embodiment of an organic light emitting display 105. The organic light emitting display 105 comprises pixel portion 130 comprising a plurality of pixels 140 formed in the regions partitioned by a plurality of scan lines S1 to Sn and a plurality of data lines D1 to Dm. The organic light emitting display 105 further comprises a scan driver 110 configured to drive the scan lines S1 to Sn, a data driver 120 configured to drive the data lines D1 to Dm, and a timing controller 150 configured to control the scan driver 110 and the data driver 120.

The scan driver 110 receives scan driving control signals SCS from the timing controller 150, and generates and sequentially supplies generated scan signals to the scan lines S1 to Sn. The scan driver 110 also generates emission control signals in response to the scan driving control signals SCS, and sequentially supplies the generated emission control signals to emission control lines E1 to En. In one embodiment, the scan driver 110 controls the emission time of the pixels 140 using the width of the emission control signals.

The data driver 120 receives data driving control signals DCS from the timing controller 150 and generates and supplies data signals to the data lines D1 to Dm in synchronization with the scan signals.

The timing controller 150 generates the data driving control signals DCS and the scan driving control signals SCS in response to synchronizing signals supplied from outside the display 105. As noted above, the data driving control signals DCS are supplied to the data driver 120 and the scan driving control signals SCS are supplied to the scan driver 110. The timing controller 150 also supplies data (Data), provided from outside the display 105, to the data driver 120.

The pixel portion 130 receives a first power source signal ELVDD and a second power source signal ELVSS for supply to the pixels 140. The pixels 140 that receive the first power source signal ELVDD and the second power source signal ELVSS generate light corresponding to the data signals. In one embodiment, the emission time of each of the pixels 140 is controlled by emission control signals generated by the scan driver 110.

Figure 5:
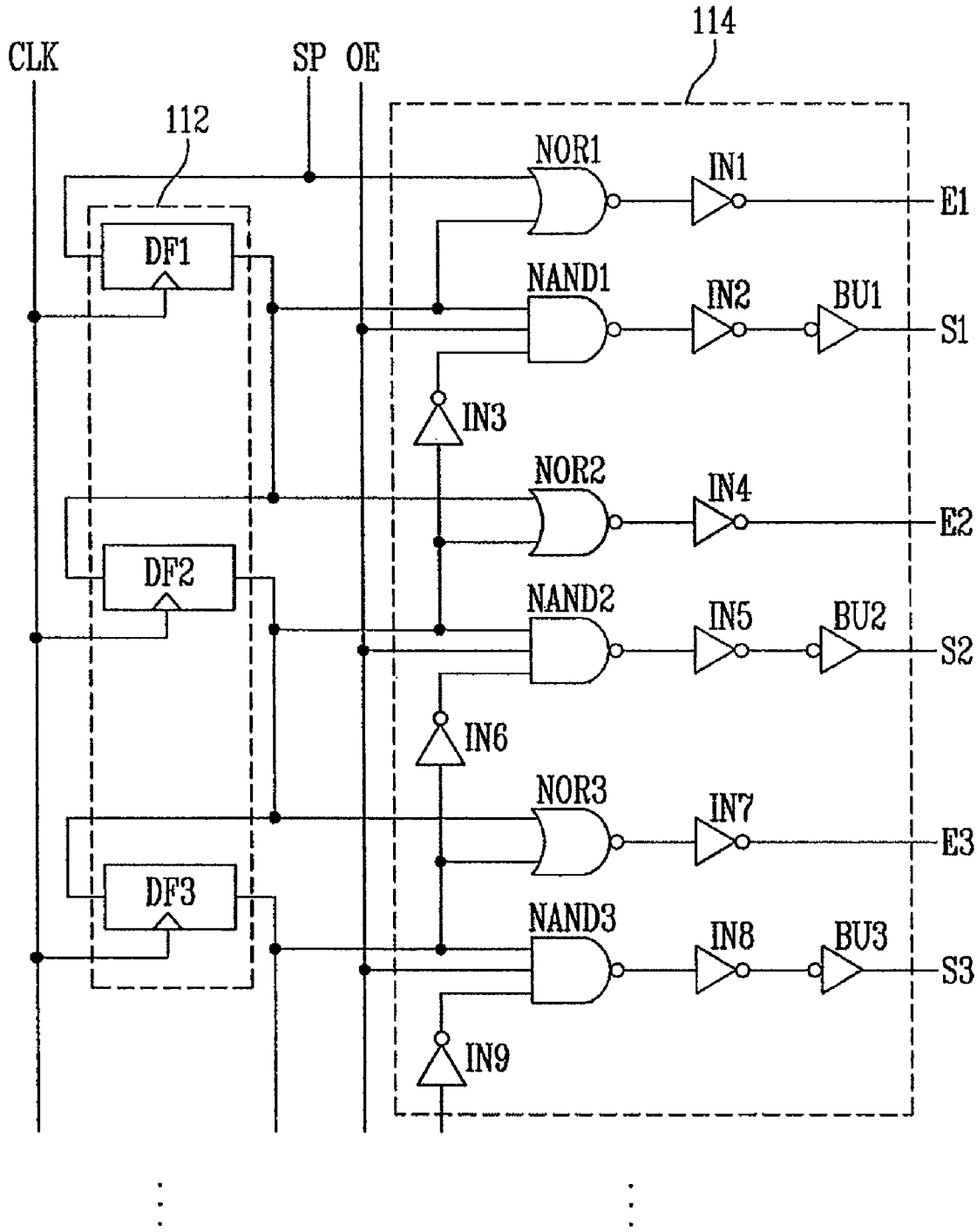
FIG. 5 is an electrical schematic of one embodiment of a scan driver of the organic light emitting display of FIG. 4.

FIG. 5 is an electrical schematic of one embodiment of the scan driver 110 of FIG. 4. Referring to FIG. 5, the scan driver 110 comprises a shift register 112 and a signal generator 114. The shift register 112 is configured to sequentially shift a start pulse SP (supplied from outside) to generate a plurality of sampling pulses. The signal generator 114 is configured to generate the scan signals and the emission control signals in response to the sampling pulses and an output enable signal OE (supplied from outside).

The shift register 112 comprises n D flip-flops (DF1 to DFn). In one embodiment, the shift register 112 comprises the same number of D flip-flops as the number of scan lines S1 to Sn (or the emission control lines E1 to En). Each of the D flip-flops DF2 to DFn generates a sampling pulse using a sampling pulse output from a previous D flip-flop. A first D flip-flop DF1 generates a sampling pulse using the start pulse SP. In one embodiment, odd D flip-flops (e.g., DF1, DF3, . . . ) are driven at the rising edge of a clock signal CLK, and even D flip-flops (e.g., DF2, DF4, . . . ) are driven at the falling edge of the clock signal CLK.

Thus, in the shift register 112, D flip-flops driven at the rising edge of the clock signal CLK and D flip-flops driven at the falling edge of the clock signal CLK are alternately arranged. In another embodiment, the odd D flip-flops DF1, DF3, . . . are driven at the falling edge of the clock signal CLK and the even D flip-flops DF2, DF4 . . . are driven at the rising edge of the clock signal CLK.

The signal generator 114 comprises a plurality of logic gates. In one embodiment, the signal generator 114 comprises a NOR gate NORi (where i is an integer) coupled between an ith emission control line Ei and an ith D flip-flop DFi, and at least one inverter IN coupled between the ith NOR gate NORi and the ith emission control line Ei. The ith NOR gate NORi performs a NOR operation on the sampling pulse output of the (i−1)th D flip-flop DF(i−1) and the sampling pulse output of the ith D flip-flop DFi.

The signal generator 114 further comprises a NAND gate NANDi coupled between the ith scan line Si and the ith D flip-flop DFi, and at least one inverter IN and at least one buffer BU coupled in series between the NAND gate NANDi and the ith scan line Si. The ith NAND gate NANDi performs a NAND operation on the sampling pulse from the ith D flip-flop DFi, the output enable signal OE, and a sampling pulse obtained by inverting the sampling pulse from the (i+1) th D flip-flop DF(i+1). For example, NAND gate NAND1 performs a NAND logic operation on the following three signals: (1) the sampling pulse output from D flip-flop DF1, (2) the output enable signal OE, and (3) a sampling pulse comprising the sampling pulse output from the D flip-flop DF2 as inverted by the inverter IN3. The output of the NAND gate NAND1 is inverted by inverter IN2 and buffered by buffer BU1, and the inverted and buffered signal is supplied to the scan line S1.

Figure 6:
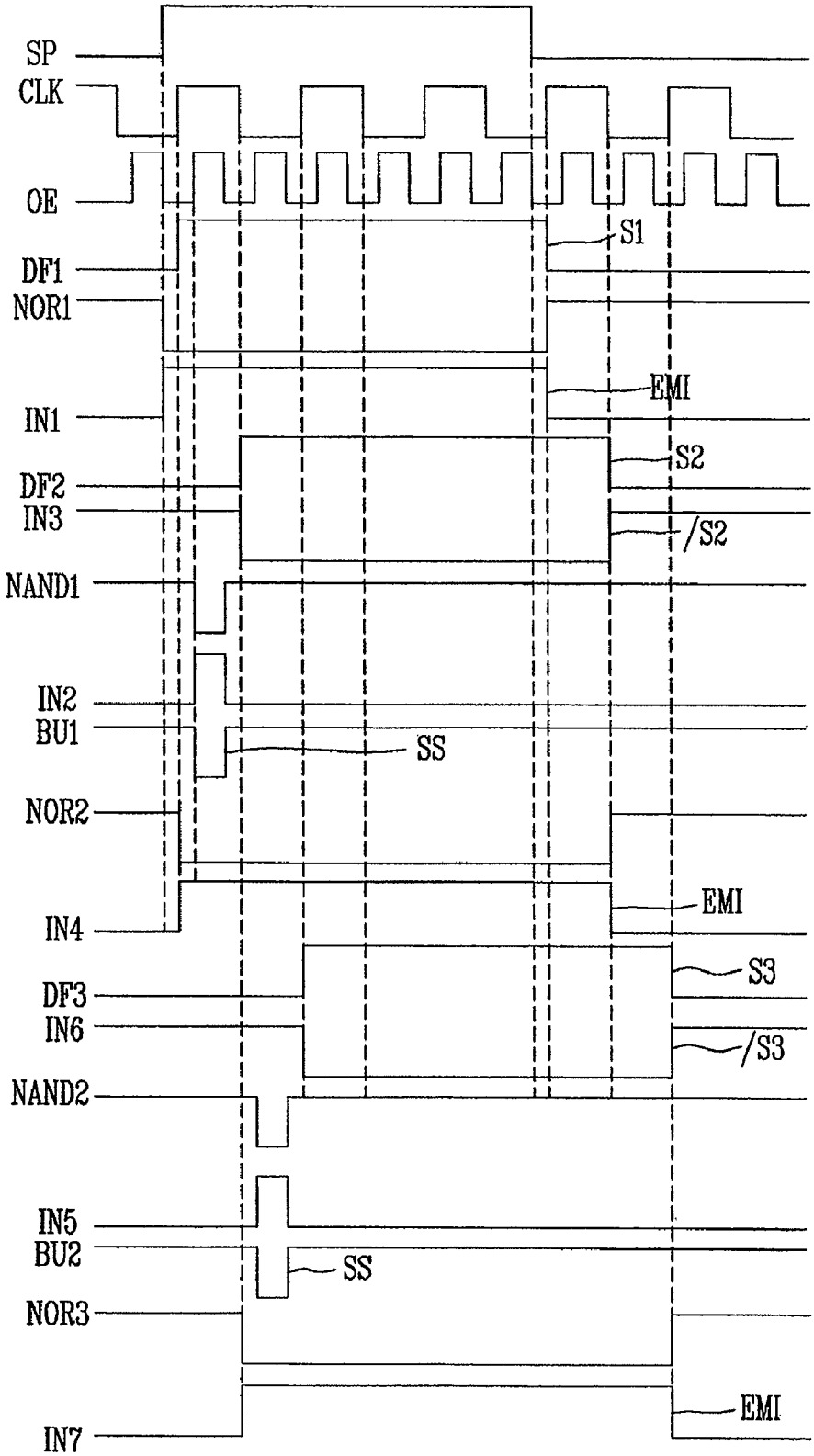
FIG. 6 is timing diagram of waveforms illustrating one embodiment of a method of driving the scan driver of FIG. 5.

FIG. 6 is an illustration of waveforms illustrating one embodiment of a method of driving the scan driver 110. The clock signal CLK and the output enable signal OE are supplied from the timing controller to the scan driver 110. In one embodiment, a period of the output enable signal OE pulse is half (½) of a period of the clock signal CLK pulse (that is, the frequency of the output enable signal OE is higher than the frequency of the clock signal CLK). The logic high voltages (logic of 1) of the output enable signal OE are generated to overlap the high voltages of the clock signal CLK, and the logic low voltages (logic of 0) of the output enable signal OE are generated to overlap the transition of the clock signal CLK from high to low and from low to high. The output enable signal OE controls the width of the pulse of scan signals SS output on the scan lines Si of the signal generator 114. In one embodiment, the pulses of the scan signals SS are generated to overlap the logic high voltages of the output enable signal OE. In other embodiments, the output enable signal OE is not supplied to the scan driver 110.

As described above, the clock signal CLK is supplied to the shift register 112, the output enable signal OE is supplied to the signal generator 114, and the start pulse SP is supplied to the shift register 112 and the signal generator 114. In one embodiment, the start pulse SP is supplied to the first D flip-flop DF1 and the first NOR gate NOR1. In one embodiment, the start pulse SP is set with various widths based on the emission time of the pixels 140. In certain embodiments, the width of the start pulse SP is set to be no less than about two periods of the clock signal CLK. The first D flip-flop DF1 that receives the start pulse SP is driven at the rising edge of the clock signal CLK to generate the first sampling pulse S1. The first sampling pulse S1 generated by the first D flip-flop DF1 is supplied to the first NOR gate NOR1, the first NAND gate NAND1, the second D flip-flop DF2, and the second NOR gate NOR2.

The first NOR gate NOR1 receives the start pulse SP and the first sampling pulse S1 and performs a NOR operation on the received pulses. That is, the first NOR gate NOR1 outputs a logic high voltage when both the start pulse SP and the first sampling pulse S1 have logic low voltages, and outputs a logic low voltage in other cases. In one embodiment, the first NOR gate NOR1 outputs the logic low voltage during a period when the start pulse SP and the first sampling pulse S1 are supplied (as logic high voltage periods). The logic low voltage output from the first NOR gate NOR1 is supplied to the first emission control line E1, via at least one inverter IN1, for use as an emission control signal EMI. In one embodiment, the width of the pulse of the emission control signal EMI is set, in response to the start pulse SP, equal to or greater than the width of the start pulse SP.

The second D flip-flop DF2 receives the first sampling pulse S1 and is driven at the falling edge of the clock signal CLK to generate a second sampling pulse S2. The second sampling pulse S2 is supplied to a second NAND gate NAND2, a second NOR gate NOR2, the first NAND gate NAND1, a third NOR gate NOR3, and a third D flip-flop DF3.

As discussed above, the first NAND gate NAND1 receives the first sampling pulse S1, the inverted second sampling pulse /S2 supplied via the inverter IN3, and the output enable signal OE. The first NAND gate NAND1 performs a NAND operation on the first sampling pulse S1, the inverted second sampling pulse /S2, and the output enable signal OE. Thus, the first NAND gate NAND1 outputs a logic low voltage when the first sampling pulse S1, the inverted second sampling pulse /S2, and the output enable signal OE have logic high voltages, and outputs a logic high voltage in other cases. The first NAND gate NAND1 outputs the logic low voltage in a period corresponding to a logic high voltage period of the output enable signal OE.

In certain embodiments, the first NAND gate NAND1 does not receive the output enable signal OE. In such an embodiment, the first NAND gate NAND1 outputs the logic low voltage in response to the first sampling pulse S1 and the inverted second sampling pulse /S2 at logic high voltages.

As noted above, the logic low voltage output pulse from the first NAND gate NAND1 has a width equal to or less than a logic high voltage period of the output enable signal OE. Thus, the width of the NAND1 logic low voltage output pulse is ½ of a period of the output enable signal OE, and the width of the NAND1 output pulse is not affected by the width of the emission control signals EMI (or the start pulse SP). The logic low voltage output from the first NAND gate NAND1 is supplied to the first scan line S1 via at least one inverter IN2 and at least one buffer BU1. The first scan line S1 supplies the low voltage as a scan signal to the pixels 140.

The second NOR gate NOR2 performs a logic NOR operation on the first sampling pulse S1 and the second sampling pulse S2 (both having logic high voltages) to output a logic low voltage. The logic low voltage output from the second NOR gate NOR2 is supplied to a second emission control line E2 via at least one inverter IN4 for use as an emission control signal EMI. In one embodiment, the width of the emission control signal EMI is set in response to the start pulse SP to be approximately equal to or greater than two periods of the clock signal CLK.

The second NAND gate NAND2 performs a logic NAND operation on the second sampling pulse S2 (logic high voltage), an inverted third sampling pulse /S3 (logic low voltage), and the output enable signal OE to output a logic low voltage in a period corresponding to a high voltage period of the output enable signal OE. The logic low voltage output from the second NAND gate NAND2 is supplied to the second scan line S2 via at least one inverter IN5 and at least one buffer BU2. The second scan line S2 supplies the low voltage as a scan signal to the pixels 140.

In one embodiment, the scan signals SS and the emission control signals EMI are generated by the scan driver 110 by repeating the above-described process. As discussed above, the width of the emission control signals EMI corresponds to the width of the start pulse SP. Accordingly, when the width of the start pulse SP is set wide, the width of the emission control signals EMI is also set wide, and when the width of the start pulse SP is set narrow, the width of the emission control signals EMI is also set narrow. Thus, the width of the start pulse SP is controlled to adjust the width of the emission control signals EMI, and to thus freely adjust the emission time of the pixels 140. In one embodiment, even if the width of the start pulse SP is set wide, only one scan signal SS is supplied to each of the scan lines S throughout the duration of the start pulse. Therefore, the scan signals SS are supplied in a stable manner to the scan lines S regardless of the width of the start pulse SP.

In the embodiments of the scan driver, the organic light emitting display, and the method of driving the organic light emitting display described above, the width of the start pulse is controllable to freely adjust the width of the emission control signals. Therefore, the brightness of the organic light emitting display can be also be adjusted. In one embodiment, regardless of the width of the start pulse, only one scan signal is supplied to each scan line during the period of the start pulse. The organic light emitting display is thus driven in a stable manner.

While the above detailed description has shown, described, and pointed out novel features of the invention as applied to various embodiments, it will be understood that various omissions, substitutions, and changes in the form and details of the device or process illustrated may be made by those skilled in the art without departing from the spirit of the invention. The scope of the invention is indicated by the appended claims rather than by the foregoing description. All changes which come within the meaning and range of equivalency of the claims are to be embraced within their scope.

What is claimed is:

1. A scan driver, configured to receive a clock signal and a start pulse, the start pulse having a duration of at least two cycles of the clock signal, and configured, in response to the clock signal and the start pulse, to generate only one emission control pulse for each of a plurality of emission control lines of a display, and to generate only one scan pulse for each of a plurality of scan lines of the display, wherein the scan driver comprises:

a shift register configured to sequentially shift the start pulse in response to receiving the start pulse and the clock signal;

a plurality of first logic gates, each configured to generate the only one emission control pulse for one of the emission control lines in response to the shifted start pulse, wherein the emission control signal has a duration of two or more clock signal periods; and a plurality of second logic gates, each configured to generate the only one scan pulse for one of the scan lines in response to the shifted start pulse, wherein the only one scan pulse has a duration of substantially no more than one clock signal period.

2. The scan driver of claim 1, wherein each second logic gate is further configured to generate the only one scan signal in response to an output enable signal having a frequency higher than the frequency of the clock signal.

3. The scan driver of claim 1, wherein the shift register comprises:

at least one odd D flip-flop driven at the rising edge of the clock signal; and at least one even D flip-flop driven at the falling edge of the clock signal.

4. The scan driver of claim 1, wherein the shift register comprises:

at least one odd D flip-flop driven at the falling edge of the clock signal; and at least one even D flip-flop driven at the rising edge of the clock signal.

5. The scan driver of claim 1, wherein the first logic gate connected to an ith emission control line performs a logic operation in response to an (i−1)th shifted start pulse and an ith shifted start pulse, and wherein i is a positive integer.

6. The scan driver of claim 5, further comprising a plurality of inverters, each coupled between one of the emission control lines and the first logic gate generating the only one emission control pulse for the emission control line.

7. The scan driver of claim 6, wherein the second logic gate connected to an ith scan line performs a logic operation in response to an ith shifted start pulse, an inverted (i+1)th shifted start pulse, and the output enable signal, and wherein i is a positive integer.

8. The scan driver of claim 7, further comprising at least one inverter and at least one buffer coupled between each scan line and the second logic gate generating the only one scan pulse for the scan line.

9. The scan driver of claim 2, wherein a period of the output enable signal is half (½) of a period of the clock signal.

10. An organic light emitting display comprising:

a data driver configured to drive a plurality of data lines;

a scan driver configured to receive a clock signal and a start pulse, the start pulse having a duration of at least two cycles of the clock signal, and configured, in response to the clock signal and the start pulse, to generate only one emission control pulse for each of a plurality of emission control lines, and to generate only one scan pulse for each of a plurality of scan lines; and a pixel portion comprising a plurality of pixels formed in regions partitioned by the scan lines, the emission control lines, and the data lines, wherein the scan driver comprises:

a shift register configured to sequentially shift the start pulse in response to receiving the start pulse and the clock signal;

a plurality of first logic gates, each configured to generate the only one emission control pulse for one of the emission control lines in response to the shifted start pulse, wherein the emission control signal has a duration of two or more clock signal periods; and a plurality of second logic gates, each configured to generate the only one scan pulse for one of the scan lines in response to the shifted start pulse, wherein the only one scan pulse has a duration of substantially no more than one clock signal period.

11. The organic light emitting display of claim 10, wherein each second logic gate is further configured to generate the only one scan pulse in response to an output enable signal having a frequency higher than the frequency of the clock signal.

12. The organic light emitting display of claim 10, wherein the shift register comprises:

at least one D flip-flop driven at the rising edge of the clock signal; and at least one D flip-flop driven at the falling edge of the clock signal.

13. The organic light emitting display of claim 10, wherein the first logic gate connected to an ith emission control line performs a logic operation in response to an (i−1)th shifted start pulse and an ith shifted start pulse, and wherein i is a positive integer.

14. The organic light emitting display of claim 13, further comprising a plurality of inverters, each coupled between one of the emission control lines and the first logic gate generating the only one emission control pulse for the emission control line.

15. The organic light emitting display of claim 14, wherein the second logic gate connected to an ith scan line performs a logic operation in response to an ith shifted start pulse, an inverted (i+1)th shifted start pulse, and the output enable signal, and wherein i is a positive integer.

16. The organic light emitting display of claim 15, further comprising at least one inverter and at least one buffer coupled between the scan line and the second logic gate connected to the ith scan line.

17. A method of driving an organic light emitting display, the method comprising:

receiving receive a clock signal and a start pulse, the start pulse having a duration of at least two cycles of the clock signal;

shifting the start pulse, using a shift register that receives the clock signal;

in response to the start pulse, generating only one emission control pulse for each of a plurality of emission control lines of the display, wherein the emission control pulse has a duration of two or more clock signal periods; and in response to the start pulse, generating only one scan signal for each of a plurality of scan lines of the display, wherein the scan pulse has a duration of substantially no more than one clock signal period.

18. The method of claim 17, wherein the scan pulse is generated in response to an output enable signal, having a frequency higher than the frequency of the clock signal.

19. The method of claim 17, wherein shifting the start pulse comprises driving odd D flip-flops at a rising edge of the clock signal and driving even D flip-flops at a falling edge of the clock signal.

20. The method of claim 17, wherein shifting the start pulse comprises driving every other stage of the shift register at the falling edge of the clock signal and driving the remaining stages of the shift register at the rising edge of the clock signal.

21. The method of claim 17, wherein generating the emission control pulse comprises:

performing a logic NOR operation in response to an (i−1)th shifted start pulse and an ith shifted start pulse, wherein i is a positive integer; and supplying a signal generated by performing the NOR operation to an emission control line via at least one inverter.

22. The method of claim 18, wherein generating the scan pulse comprises:

performing a logic NAND operation in response to an ith shifted start pulse, an inverted shifted start pulse generated by inverting an (i+1)th shifted start pulse, and the output enable signal; and supplying a signal generated by performing the NAND operation to a scan line via at least one inverter and at least one buffer.

23. The method of claim 22, wherein a period of the output enable signal is substantially equal to half (½) of a period of the clock signal.

24. The scan driver of claim 1, wherein the first logic gates comprise NOR gates, and the second logic gates comprise NAND gates.

25. The display of claim 10, wherein the first logic gates comprise NOR gates, and the second logic gates comprise NAND gates.

* * * * *